US005542406A

United States Patent [19]

Oneto

[11] Patent Number: 5,542,406

[45] Date of Patent: Aug. 6, 1996

[54] RETRACTABLE BOLT ASSEMBLY FOR COMPRESSED GAS POWERED GUN

[76] Inventor: Michael A. Oneto, 32 Dawes Rd., Marlboro, N.Y. 12542

[21] Appl. No.: 294,071

[22] Filed: Aug. 22, 1994

[51] Int. Cl.[6] ..... F41B 11/06

[52] U.S. Cl. ..... 124/73; 124/71; 124/56; 124/50

[58] Field of Search ..... 124/71–74, 75, 124/76, 60, 56, 58, 69, 77, 70, 61, 27, 50, 53, 51.1

[56] References Cited

U.S. PATENT DOCUMENTS

| | | | |
|---|---|---|---|
| 71,162 | 11/1867 | Hall | 124/27 X |
| 511,069 | 12/1893 | Brown | 124/29 |
| 1,269,851 | 6/1918 | Plauschinat | 124/27 |
| 1,862,698 | 6/1932 | Mihalyi | 124/69 X |
| 2,528,462 | 10/1950 | Wells | 124/61 |
| 2,634,717 | 4/1953 | Junkin | 124/75 |
| 3,219,022 | 11/1965 | Hagemeyer | 124/61 |
| 4,531,503 | 7/1985 | Shepherd | 124/76 |
| 4,819,609 | 4/1989 | Tippman | 124/72 |
| 5,282,454 | 2/1994 | Bell et al. | 124/56 X |
| 5,285,765 | 2/1994 | Lee | 124/50 |
| 5,333,594 | 8/1994 | Robinson | 124/71 X |
| 5,383,442 | 1/1995 | Tippmann | 124/75 X |

*Primary Examiner*—Anthony Knight
*Attorney, Agent, or Firm*—Joseph L. Spiegel

[57] ABSTRACT

A compressed gas powered gun for firing fragile projectiles includes a bolt assembly that will retract and not fracture a projectile when it gets hung up in the breech due to misalignment with the barrel. The bolt assembly includes a front section that will come in contact with the projectile and direct gas at same, a back section for securing the bolt assembly to the cocking mechanism of the gun, a rod extending from the front section and slidable within the rear section and a spring positioned between the front and back sections about the rod so that the front section will retract when coming in contact with a projectile hung up in the breech of the gun.

9 Claims, 3 Drawing Sheets

RETRACTABLE BOLT ASSEMBLY FOR COMPRESSED GAS POWERED GUN

BACKGROUND OF THE INVENTION

1. Field of the Invention

This invention relates generally to compressed gas powered guns and more particularly to such guns for firing fragile projectiles such as paint balls.

Compressed gas powered guns such as marking guns for firing fragile projectiles such as paint balls normally include: a compressed gas source; a projectile supply magazine for holding a plurality of projectiles; a barrel through which the projectiles may be discharged as fed by gravity from the magazine; and, some form of firing mechanism including trigger and a slidable bolt assembly to release compressed gas from its source to expel a projectile through the barrel.

Normally, the bolt assembly is axially aligned with the barrel and the projectiles are fed at right angles to the barrel in front of the bolt assembly. A problem with prior art guns is that the projectile is not always fed to a point where it is aligned with the barrel because it does not drop all the way down from the magazine. Thus, when the gun is fired and the bolt assembly moves forward the projectile breaks, it is not expelled from the barrel and the contents of the projectile are dispersed within the gun. At this occurrence, the gun must be disassembled and cleaned before it can be used again. The present invention is directed towards a solution to this problem.

2. Description of the Prior Art

Hall, U.S. Pat. No. 71,162 describes a toy pistol in which the balls are fed from an upper magazine into and then fired from a lower barrel. The balls are discharged via a spring actuated piston or cylinder. A similar type toy machine, but with a rotary cam engaging the plunger or piston to initially retract and then advance same is shown in Brown, U.S. Pat. No. 511,069.

Plauschinat, U.S. Pat. No. 1,269,851 is representative of a type pistol employing a spring loaded plunger for shooting small lead shot.

Junkin, U.S. Pat. No. 2,634,717 describes an air gun with a valve contact mechanism for projecting balls.

Shepherd, U.S. Pat. No. 4,531,503 describes a fluid pressure repeating pistol having a spring loaded striker which, when pulled back and released, will move forward striking an air valve releasing air and firing a ball. Shepherd, along with Tippmann, U.S. Pat. No. 4,819,609; Bell et al., U.S. Pat. No. 5,282,454; and, Lee, U.S. Pat. No. 5,285,765, typify prior art gas powered paint ball guns. It is to be noted, however, that the prior art is not concerned with nor offers a solution to the problem with which the present invention is concerned.

SUMMARY OF THE INVENTION

Accordingly, the primary object of this invention is the provision of a compressed gas powered gun for firing fragile projectiles such as paint balls which will not break the projectile in case they are not fed completely from the magazine of the gun into position for firing.

Briefly, the invention contemplates the use of some means that allows the bolt assembly of the gun to retract and not break a fragile projectile hung up in the breech of the gun due to misalignment with the barrel. In a specific embodiment to be described, the bolt assembly includes a front section and back section, a rod extending from the front section and slidable within the back section and a spring positioned between the front and back sections about the rod whereby the front section will retract when coming in contact with a projectile hung up in the breech of the gun.

BRIEF DESCRIPTION OF THE DRAWING

Other objects and advantages of the invention will be apparent from the following description taken in connection with the accompanying drawing where.

DESCRIPTION OF THE PREFERRED EMBODIMENTS

Figure 1:
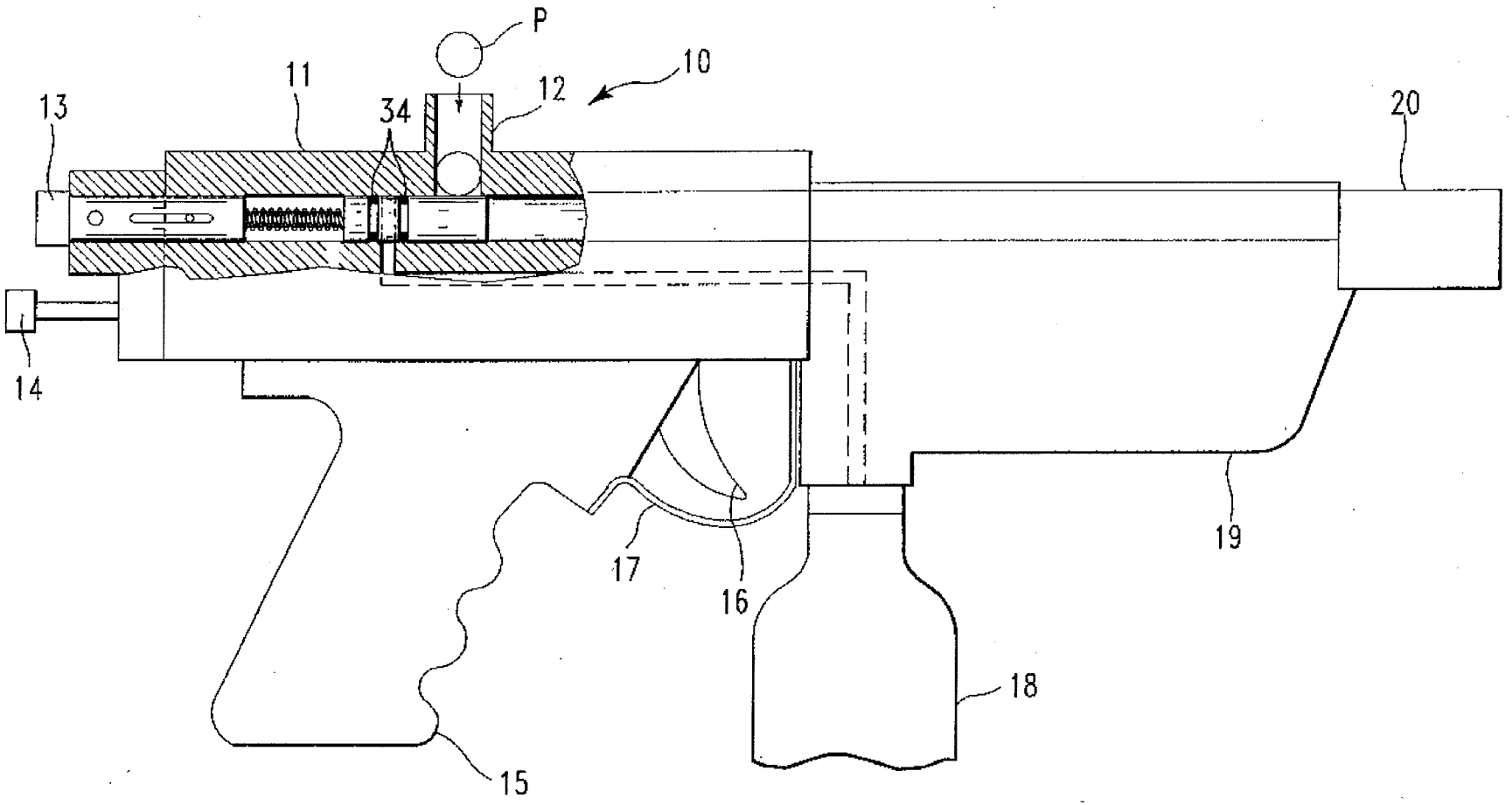
FIG. 1 is a side elevation view, partially in section and partly broken away, showing a compressed gas powered gun in uncocked position.
Figure 2:
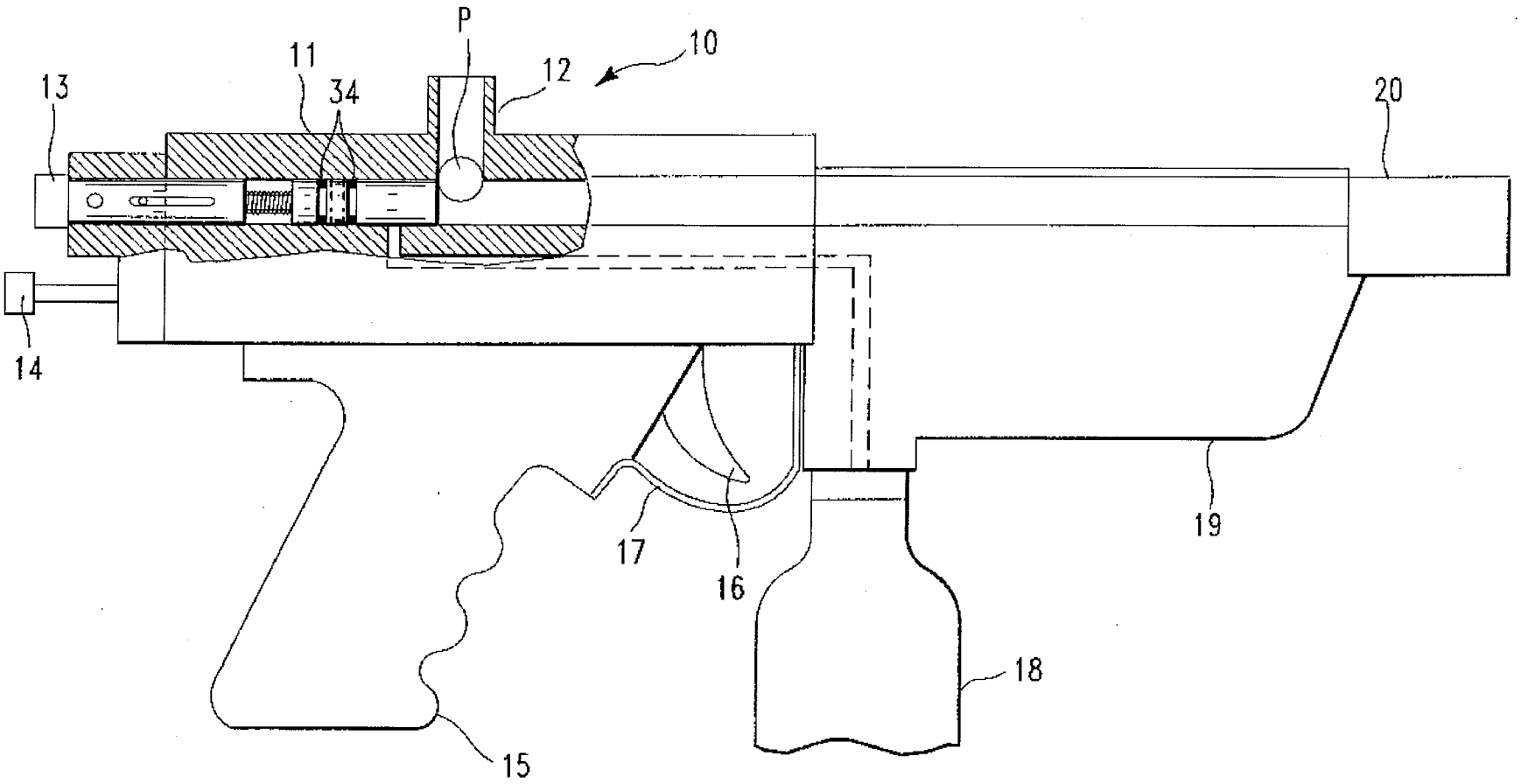
FIG. 2 is a view similar to FIG. 1 but showing the gun with the bolt assembly in retracted position and a projectile hung up in the breech.

Referring now to FIGS. 1 & 2 of the drawing, many parts of the compressed gas powered gun are conventional and are only shown to the extent necessary for an understanding of the present invention. Thus, the gun 10 is seen as including a main body 11 with feeder tube 12 which acts as a conventional magazine to feed fragile projectiles P such as paint balls, bolt assembly 13, cocking rod 14, receiver 15 for the body of the gun, trigger 16, trigger guard 17, compressed gas source 18, forward grip 19 and barrel 20.

FIG. 1 shows the bolt assembly 13 in forward position with the next projectile P to be fed from the tube 12 resting above the assembly.

FIG. 2 shows the bolt assembly 13 retracted for receipt of the next projectile P and is illustrative of the problem to which the present invention is directed.

It sometimes happens that the projectile P does not drop all the way down from the feeder tube 12 into the breech of the gun. Then, when the gun 10 is fired, the bolt assembly 13 moves forward but it does not move the projectile forward from the breech to the barrel 20 where it is expelled. Instead, the projectile is hung up in the breech and broken by the forward movement of the bolt assembly 13. The contents of the projectile are then dispersed within the gun 10. At this occurrence, the gun 10 must be disassembled and cleaned before it can be used again.

The forgoing problem is overcome by the novel bolt assembly of the present invention illustrated in greater detail in FIGS. 3–10 of the drawing.

Figure 3:
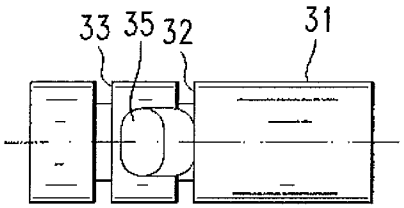
FIG. 3 is a bottom view of the front section of the novel bolt assembly of the present invention.
Figure 4:
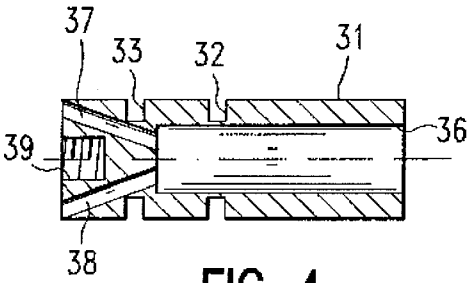
FIG. 4 is a cross sectional view of the front section of the novel bolt assembly of the present invention.

Referring now to FIGS. 3 and 4, the bolt assembly 13 has a front section 31 whose forward end will come in contact with the projectile P. The section is provided with external circumferential grooves 32, 33 for receipt of O-Rings 34 (see FIG. 1) for sealing engagement with the main body 11 of the gun 10.

A radial, somewhat elliptically shaped slot 35 leads to a central axial opening 36. Compressed gas is directed from the source 18 through the slot 35 and out the axial opening 36 to fire the projectile P, directing it forward.

The rear end of the front section 31 is provided with a pair of blow back holes 37, 38. When gas is being expelled through the axial opening 36 towards the projectile P, there is a tendency for the entire bolt assembly 13 to retract within the main body 11. By the assembly 13 not remaining forward, the velocity of the projectile P will be diminished before the projectile P has been discharged from the barrel 20. The blow back holes 37, 38 allow gas to build up behind the front section 31 and, thus, prevent the bolt assembly 13 from moving backward.

The rear end of the front section 31 is also provided with an interiorly threaded portion 39 for a purpose to be explained hereafter.

Figure 5:
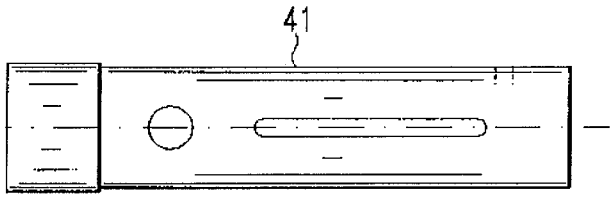
FIG. 5 is a side view of the rear section of the novel bolt assembly of the present invention.
Figure 7:
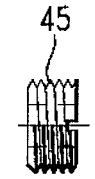
FIG. 7 is a side view of the length adjustment screw used in the present invention.
Figure 6:
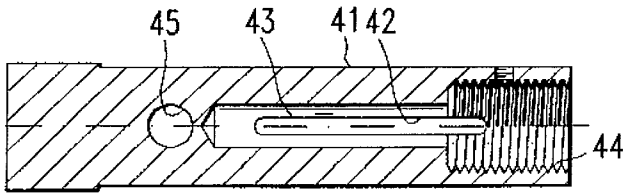
FIG. 6 is a section view of the rear section of the novel bolt assembly of the present invention.
Figure 11:
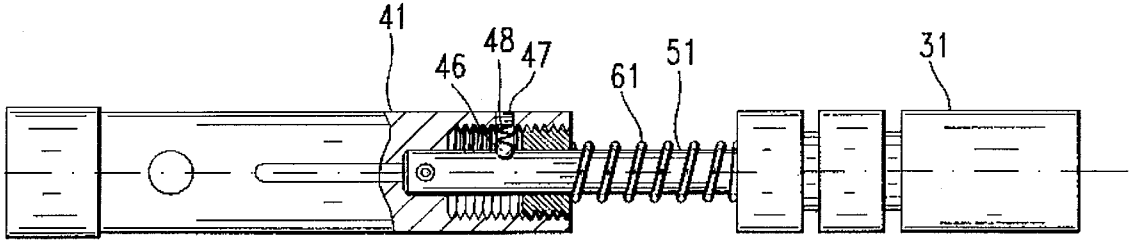
FIG. 11 is a side view partially in section and partly broken away of the bolt assembly of the present invention.

Referring to FIGS. 5 and 6, the bolt assembly is seen as including a back section 41 having a narrow central opening 42, longitudinal slots 43, an interiorly threaded insert 44 at the forward end of the section and a through hole 45 towards the rear end of the section 41. The threaded section 44 is adapted to receive a centrally apertured adjustment screw 45' (FIG. 7). This screw 45' is adjustable to adjust the total length of the bolt assembly 13. The hole 45 towards the rear end of the back section is adapted to receive a pin (not shown) for securing the bolt assembly 13 to the cocking mechanism 14.

The back section 41 is also provided with a ball bearing 46 held in a slot by an Allen screw 47 and biased inwardly by a spring 48, for a purpose to be described hereafter.

Figure 8:
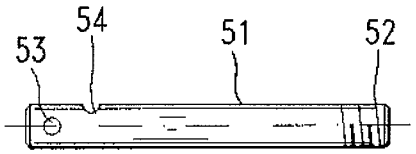
FIG. 8 is a side view of the rod used between the front and rear sections of the bolt assembly.
Figure 9:
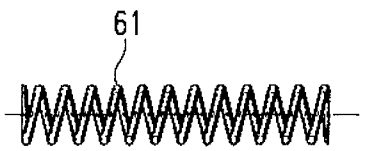
FIG. 9 is a side view of the retractor spring.
Figure 10:
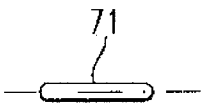
FIG. 10 is a side view of a roll pin.

Referring to FIG. 8, the bolt assembly is further provided with a rod 51 having a forward threaded portion 52 and a through hole 53 towards the rear end. The rod forward end 52 is threaded into the threaded portion 39 of the rear end of the front section 31 of the bolt assembly 13. Then a spring 61 (FIG. 9) is placed around the rod 51 and the rear end of the rod is inserted into the opening 42 in the back section 41 of the bolt assembly 13 through the adjustment screw 45' and threaded insert 44 and aligned in such a manner that a roll pin 71 (FIG. 10) may be press fit into the through hole 53 to allow the roll pin 71 to ride back and forth within the slots 43. The forward movement of the roll pin 71 is limited by contact with the threaded insert 44. The rod 51 is also provided with a detent 54 in which the ball bearing 46 will fit under normal conditions.

The rod 51 provides alignment between the front 31 and back 41 sections of the bolt assembly and also provides the mounting surfaces for the spring 61.

The spring 61 allows movement of the front section 31 relative to the back section 41 when coming in contact with a misaligned projectile P, thus preventing damage and destruction of the projectile P that has become misaligned in the breech with the barrel 20 of the gun 10 during the cocking process.

The roll pin 71 serves the added function of maintaining correct alignment of the opening in the front section 31 with a flow hole (not shown) in the air chamber of the gun.

In normal use, the gun 10 will be cocked and then fired in the usual fashion. The bolt assembly 13 is driven forward to move the projectile P from the breech into the barrel 20 where then compressed gas entering the assembly is directed at the projectile P to drive it from the barrel 20. The spring 61 is not in any way compressed and the roll pin 71 remains in contact with the threaded insert.

Sometimes the projectiles P are out-of-round and the front section 31 could retract slightly due to resistance between the front section 31 and out-of-round projectiles P. This problem is overcome by the detent 54, ball bearing 46 and spring 48 acting as a locking mechanism to prevent the front section 31 from moving rearward under these conditions. Enough tension remains to move the out-of-round forward from the breech to the barrel.

In the situation where a projectile P does not drop all the way down into the breech and is out of alignment with the barrel 20, the bolt assembly 13 is driven forward but the front section 31 retracts, upon contact with the misaligned projectile P, holding same in place and the slide pin 71 moves within the slots. Then the gun is recocked to allow the projectile to fall in place.

It should be obvious that changes, additions and omissions may be made in the details and arrangement of parts without departing from the spirit and scope of the invention.

What is claimed is:

1. In a compressed gas powered gun for firing fragile projectiles from the breech of the gun that includes a projectile supply magazine for feeding projectiles to the breech of the gun and a bolt assembly that rides within the main body of the gun for driving a projectile from the breech to the barrel for firing, the invention comprising an improved bolt assembly that prevents breakage of the projectile when the projectile gets hung up in the breech due to misalignment with the barrel, said bolt assembly including:

a front section having a forward end for contact with the projectile upon forward movement of the bolt assembly; and, means to retract said front section upon contact with a misaligned projectile.

2. In a compressed gas powered gun for firing fragile projectiles from the breech of the gun that includes a projectile supply magazine for feeding projectiles to the breech of the gun and a bolt assembly that rides within the main body of the gun for driving a projectile from the breech to the barrel for firing, the invention comprising an improved bolt assembly that prevents breakage of the projectile when the projectile gets hung up in the breach due to misalignment with the barrel, said bolt assembly including:

a front section having a forward end for contact with the projectile upon forward movement of the bolt assembly;

a back section adapted for securement to a cocking mechanism of the gun;

a rod extending from the front section and slidable within the back section; and, a spring positioned between the front section and back section about the rod whereby the front section will retract when coming in contact with a projectile hung up in the breech of the gun.

3. The invention defined by claim 2 wherein the front section is provided with a radial slot to direct compressed gas into a forward end of the front section and an axial opening in communication with the radial slot to direct a projectile from the barrel of the gun.

4. The invention defined by claim 2 wherein the front section is provided with external grooves disposed on either side of the radial slot and seals in the grooves for sealing engagement with the main body of the gun.

5. The invention defined by claim 3 including holes in a rear end of the front section in communication with the axial opening to direct compressed gas behind the front section.

6. The invention defined by claim 2 wherein the back section includes a central opening for slidably receiving the rod, the end of the rod within the back section is provided with a -transverse hole for receipt of a roll pin, the back section is provided with longitudinal slots, and a roll pin positioned within the rod transverse hole for riding within the longitudinal slots.

7. The invention defined by claim 2 wherein the rod is provided with a detent and the back section is provided with an inwardly biased ball bearing adapted to ride in the rod detent and act as a locking mechanism.

8. The invention defined by claim 2 including means for adjusting the length of the bolt assembly.

9. The invention defined by claim 2 wherein a front end of the back section is provided with a threaded interior for receipt of a screw and a screw for engagement in the threaded section to adjust the length of the bolt assembly.

* * * * *